United States Patent [19]

Beck et al.

[11] Patent Number: 4,649,238

[45] Date of Patent: Mar. 10, 1987

[54] CLUTCH ACTUATOR SWITCH

[75] Inventors: Willi K. Beck, Hingham; Andrew Strange, Watertown, both of Mass.

[73] Assignee: Joseph Pollak Corporation, Boston, Mass.

[21] Appl. No.: 803,319

[22] Filed: Dec. 2, 1985

[51] Int. Cl.[4] ..... H01H 15/00

[52] U.S. Cl. ..... 200/16 C; 200/303

[58] Field of Search ..... 200/16 R, 16 A, 16 B, 200/16 C, 16 D, 16 E, 16 F, 243, 303, 302.1, 302.2, 302.3, 153 C, 153 LA, 61.89

[56] References Cited

U.S. PATENT DOCUMENTS

| | | | |
|---|---|---|---|
| 3,015,001 | 12/1961 | Woofter | 200/16 C |
| 4,239,947 | 12/1980 | Breitung et al. | 200/61.89 |
| 4,354,069 | 12/1982 | Ragen | 200/16 R |

*Primary Examiner*—A. D. Pellinen
*Assistant Examiner*—Morris Ginsburg
*Attorney, Agent, or Firm*—Kenway & Jenney

[57] ABSTRACT

A multi-function actuator switch attaches onto an actuator of already assembled clutch assembly or the like with a simple sideways snap-fit, is fully enclosed when assembled onto the shaft, and is compact. The switch has a hollow housing with a longitudinal opening. The housing carries in its interior a driver member that snap-fits onto the shaft. A pair of coil springs held on guide arms urge the driver toward an initial position. The arms are mounted on a base plate that closes one end of the housing and also snap-fits on the shaft. A replaceable cover closes the longitudinal opening in the housing and locks the housing onto the shaft. The housing mounts a terminal board that carries a molded in place set of interior contacts that each connect with a terminal at the exterior of the housing. The driver carries a wiper contact that makes electrical connections between selected pairs of contacts as a function of its position in the switch to control the operation of circuits associated with those contacts. In the preferred form, the driver also carries a cam mechanism that operates a spring contact that controls one circuit.

14 Claims, 9 Drawing Figures

CLUTCH ACTUATOR SWITCH

BACKGROUND OF THE INVENTION

This invention relates in general to switches and more specifically to a multi-function actuator switch that is replaceably secured on a linearly translating actuator shaft, such as a clutch push rod, that is part of an already assembled mechanism, such as a hydraulic clutch master cylinder assembly.

In the automotive and hydraulic equipment industries there is a need for switches to control operating conditions in response to the position of a movable shaft such as a clutch push rod. In motor vehicles such switches are used, for example, to activate an ignition interlock circuit (this ensures that the engine will not start unless the clutch is engaged), or to control cruise control or electronic fuel injection (EFI) equipment, all in response to the position of the clutch. Of course, switches that operate in response to the linear movement of an actuating member such as a clutch shaft are well known. However, heretofore there has been a problem in providing a switch which can control multiple functions (e.g. ignition interlock, cruise control and EFI) in response to clutch position and which is also compact and easily operatively coupled to an assembled clutch mechanism. Compactness is important because in assembly of a clutch mechanism to a vehicle it is desirable to feed the master cylinder clutch push rod, and any switch assembled on the push rod, from the engine compartment, through a small diameter hole in the firewall, to the passenger compartment. It is also important that the switch be sealed against dirt and is otherwise highly reliable and durable.

It is therefore a principal object of the present invention to provide an actuator switch which can be operatively coupled to an already assembled actuator assembly such as a hydraulic clutch or a conventional mechanical clutch.

Another object is to provide a single switch which can control multiple electrical circuits in response to the position of an associated actuator shaft and which is compact.

A further object is to provide a switch with the foregoing advantages that is fully enclosed once it is assembled onto the actuator shaft.

Another object is to provide a switch with the foregoing advantages that is readily assembled from its own component parts prior to assembly onto the associated actuator shaft.

Yet another object is to provide a switch with the foregoing advantages that locks onto the actuator shaft once assembled and enclosed.

A still further object is to provide a switch with the foregoing advantages that is also reliable, durable and has a favorable cost of manufacture.

SUMMARY OF THE INVENTION

A multi-function actuator switch for clutches and the like has a housing formed from a resiliently deformable material with a longitudinal opening in one side wall and a C-shaped recess in at least one end wall which is adapted for a sideways snap fit onto a push rod of the clutch. A driver member, which also snap-fits sideways onto the push rod, travels longitudinally within the interior of the housing in coordination with movements of the push rod. In the preferred form, a removable base member encloses one end of the housing. At least one coil spring guided on an arm secured to the base urges the driver toward an initial rest position. The ends of the arms are supported by the opposite end wall of the housing. The base member, driver and springs are assembled to the housing by securing the ends of the bars protruding from the end wall, whether by a snap fit, retaining rings, an ultrasonic weld, or other technique. A replaceable cover closes the longitudinal opening and secures the housing against an outward lateral deformation, thereby locking it on the push rod.

In the preferred form, the housing mounts a terminal board that carries a set of contacts facing the housing interior and conductive paths from each contact to a terminal projecting from the exterior of the housing. The driver mounts a wiper contact, preferably resiliently mounted, which, depending on the position of the driver, electrically connects a pair of the contacts to close an associated electrical circuit. In the preferred form the driver also mounts a cam element that operates a contact spring bridging a pair of contacts also connected through the terminal board to "exterior" terminals. Also, in the preferred form, the housing includes an integrally molded connector shroud that surrounds the exterior terminals and brackets that receive and engage the locking cover.

These and other features and objects of the present invention will be more fully understood from the following detailed desription which would be read in light of the accompanying drawings.

DETAILED DESCRIPTION OF THE PREFERRED EMBODIMENTS

Figures 1, 2:
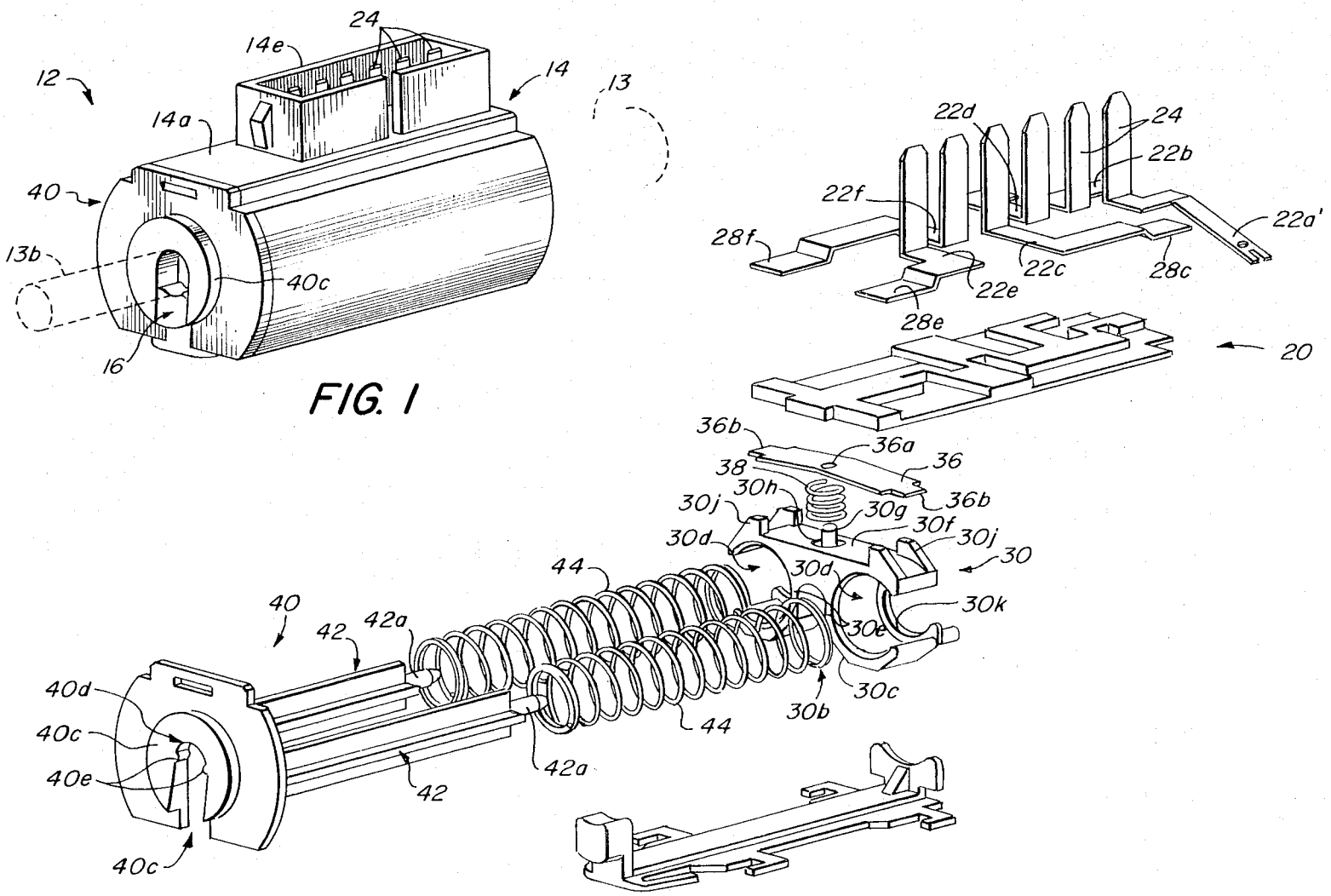
FIG. 1 is a view in perspective of a multi-function clutch actuator switch according to the present invention with an associated clutch push rod shown in phantom.
FIG. 2 is an exploded perspective view of the internal components of the switch shown in FIG. 1.
Figure 4:
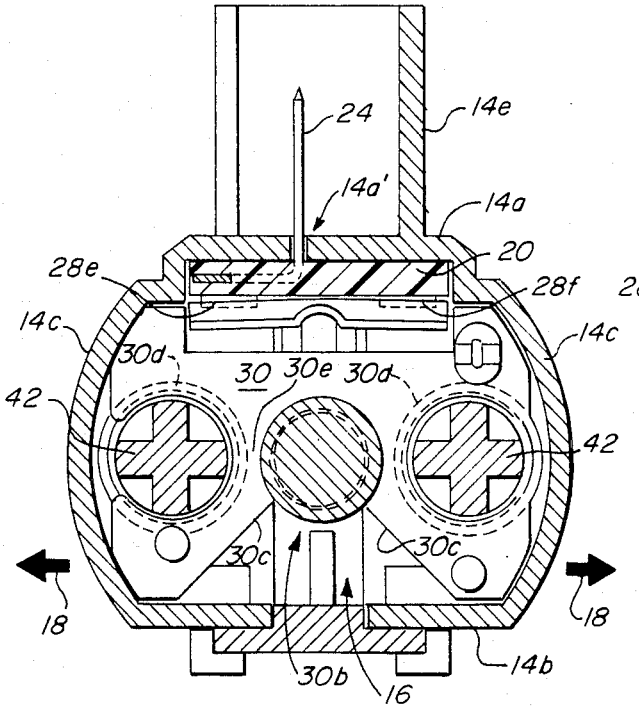
FIG. 4 is a view in vertical cross section taken along the line 4—4 in FIG. 3.
Figure 5:
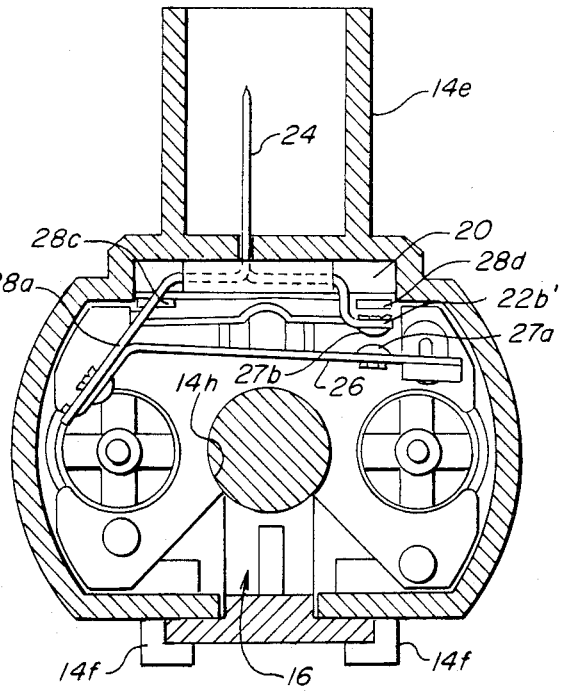
FIG. 5 is a view in vertical cross section taken along the line 5—5 in FIG. 3.

With reference to FIGS. 1 and 2, a multi-position actuator switch 12 is shown assembled onto and operatively coupled to a generally cylindrical actuator shaft 13, as shown, a master cylinder clutch push rod for a hydraulic clutch assembly. The switch 12 has a molded, resiliently deformable hollow housing 14 with a generally flat upper wall **14*a*, an opposite, generally flat bottom wall 14b, curved side walls 14c,14c, and end wall 14d, a connector shroud 14e located on the upper wall 14a, and cover plate mounting brackets 14f, all formed integrally as a one-piece molding, preferably from a material such as 30% glass filled nylon. The bottom wall 14b has a central, longitudinally extending opening 16 that is preferably slightly narrower than the maximum outside diameter of the push rod 13 (but at least as wide as a reduced diameter portion 13b). The side walls are sufficiently thin that in cooperation with the resiliency of the material they can deflect laterally outwardly, as indicated by arrows 18,18 (FIG. 4), to allow the housing end wall 14d to be snap-fit sideways onto the push rod after the housing is fed onto the reduced diameter rod portion 13b through the opening 16. The end wall 14d contains a generally C-shaped opening 14h (FIG. 5) that closely surrounds the adjacent portion of the rod 13** after assembly.

Electrical connection is made through a connector board 20 mounted within the housing under the upper housing wall 14a. As can be best seen in FIGS. 2, 3 and 5, the board can be a rectangular plate of insulating material molded to receive and support a set of conductive paths 22a, 22b, 22c, 22d, 22e and 22f. Each path is preferably formed integrally with an associated upright blade terminal 24, the six blade terminals being arrayed in a generally co-planar fashion along the longitudinal axis of the switch to accept a standard female connector (not shown) leading to the circuits to be controlled. The terminals project upwardly through a narrow opening 14a' in the upper wall 14a so that they are exterior to the switch, lie within the protecting shroud 14e, and the terminal board blocks the entrance of contaminants into the interior of the switch. The conductive path 22a also connects to an integrally formed mounting bracket 22a' that projects into the switch and mounts a contact spring 26. The conductive path 22b in turn connects to an integral interior extension piece 22b' that supports a contact 27b shown as a rivet. The free end of the contact spring 26 also carries a contact 27a shown as a rivet that is normally in electrical connection with the contact 27b. The contact spring therefore normally connects the contacts 27a and 27b to close the associated circuit (in the preferred embodiment, an electronic fuel injection circuit). Contacts 28c and 28d are associated with paths 22c and 22d, respectively, and contact pair 28e and 28f are associated with paths 22e and 22f, respectively. The pairs 28c, 28d and 28e, 28f are each arranged generally transversely to the longitudinal axis of the switch. Each pair is located near opposite ends of the housing. In the preferred form, as shown, these electrically conductive components are insert molded into the board (shown in phantom in FIG. 2).

A movable switch member, a driver 30, is mounted within the housing 14. The exterior profile of the driver 30 closely conforms to the interior profile of the housing so that the driver is guided, at least in part, by the interior walls of the housing as it translates between an "initial" or "rest" limit position 32 shown in FIG. 6 and a "clutch-fully-depressed" limit position 34 shown in FIG. 7. The driver is operatively coupled to the push rod 13. In the preferred form shown, the rod has a shoulder 13a (FIG. 7) at the beginning of a reduced diameter portion 13b. This shoulder abuts and operatively engages the adjacent end face 30a of the driver. As a result, a linear translation of the push rod 13, to the left as shown, also translates the driver to the left. The driver is also coupled to the push rod 13 by a sideways snap-fit. To this end, the driver 30 is formd of a resiliently deformable insulating material such as the 30% glass filed nylon of the housing, and it has a central recess 30b (FIG. 2) with a generally C-shaped configuration adapted to snap-fit over the reduced diameter rod portion 13b. Walls 30c,30c below the recess 30b are mutually inclined to guide the rod to the recess. In addition, the driver has a pair of recesses 30d,30d located symmetrically about the central recess 30b which result in walls 30e,30e that can be deformed sufficiently to allow the snap-fit, but which are sufficiently thick to hold the driver on the rod once it is assembled.

The upper surface of the driver has a generally flat, recessed surface 30f that receives a wiper contact 36. A mounting post 30g is formed integrally with the driver and extends upwardly from within a counter-sunk recess 30h in the surface 30f to mate with a hole 36a in the wiper contact. A coil spring 38 is received in the recess 30h and provides a resilient mount for the wiper contact 36. End tabs 36b,36b of the wiper contact are received between four corner posts 30j that project upwardly from the surface 30f. This arrangement secures the wiper contact in a desired transverse orientation with respect to the direction of translation of the driver 30 so that the wiper contact 36 electrically connects the contact pair 28c and 28d when the driver is in position 32 and connects contact pair 28e and 28f when it is in position 34. In the preferred form, in position 32 the wiper contact closes a cruise control circuit and in position 34 it closes an ignition interlock circuit. The wiper preferably has a short travel over each contact to remove oxides and contaminants that accumulate on the electrical connection surfaces.

A base member 40 with a pair of integrally formed arms 42,42 closes the open end of the housing 14 opposite the housing end wall 14d. Inwardly facing projections 40a and 40b locate the base member with respect to the housing. An exterior boss 40c reinforces the base and surrounds an open recess 40d that terminates in a C-shaped region that also snap-fits over the rod portion 13b. Note that to facilitate the sideways insertion of the rod, the recess preferably has a width that closely conforms to the outer diameter of the rod portion 13b, except for two opposed, rounded projections 40e,40e that restrict the recess opening immediately "below" the rod 13b when it is fully engaged in the recess. The assembly of the actuator switch 12 to the actuator shaft 13 is therefore principally through the snap-fits at the base 40 and the driver 30.

Each arm 42 carries a coil spring 44 that at one end bears against the inner face 40 of the base 40f and at the other end against a circumferential lip 30k at the far end of the recess 30d formed in the driver. The springs urge the driver toward the initial position 32. The arms prevent the springs from buckling when they are compressed as the driver travels away from position 32. While the arms could have a circular cross section, it is preferably X-shaped to reduce the material needed to form the arms and to reduce the friction between the arms and both the springs and the driver which move over them.

Figure 3:
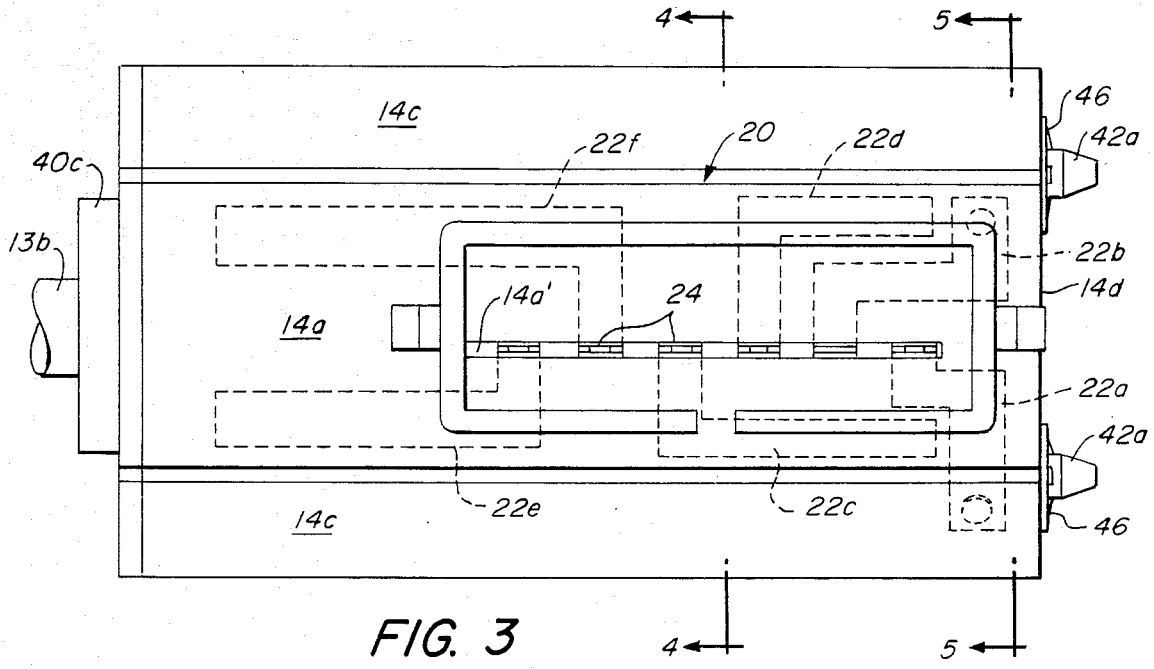
FIG. 3 is a top plan view of the switch shown in FIG. 1 with the electrical connection paths between the interior contacts and the exterior terminals shown in phantom.
Figure 6:
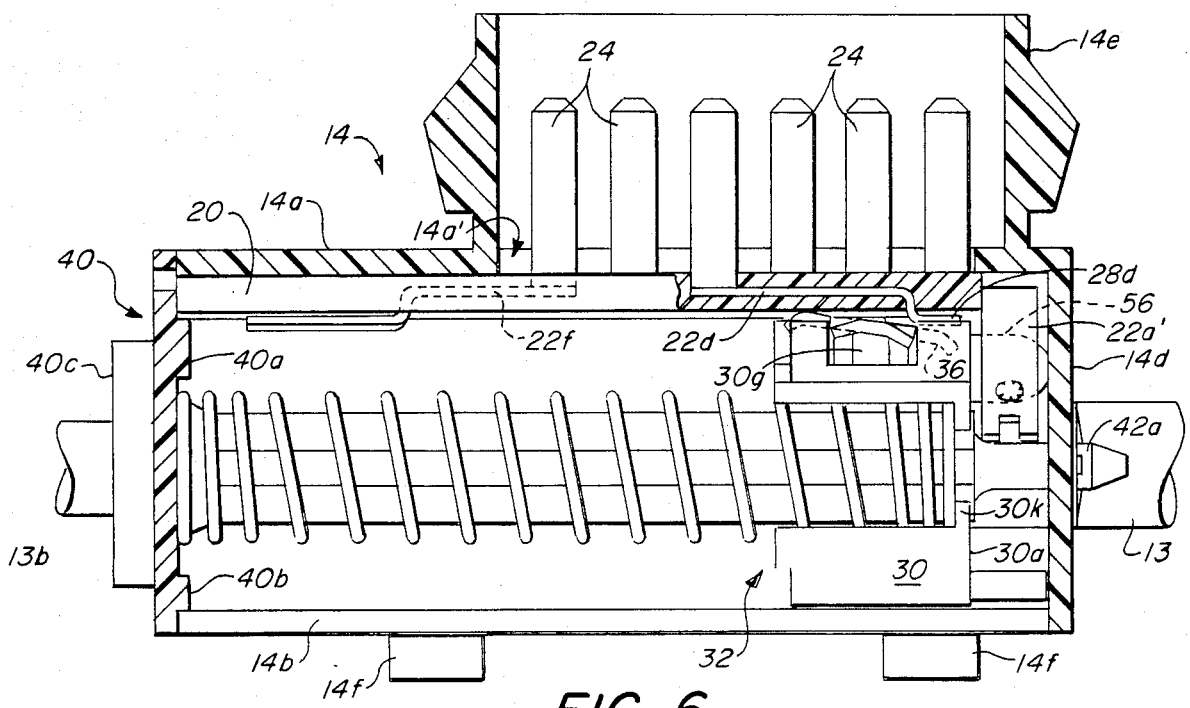
FIG. 6 is a view in vertical cross section taken along the central axis of the switch shown in FIGS. 1–5 with the push rod and driver in an initial limit position.
Figure 7:
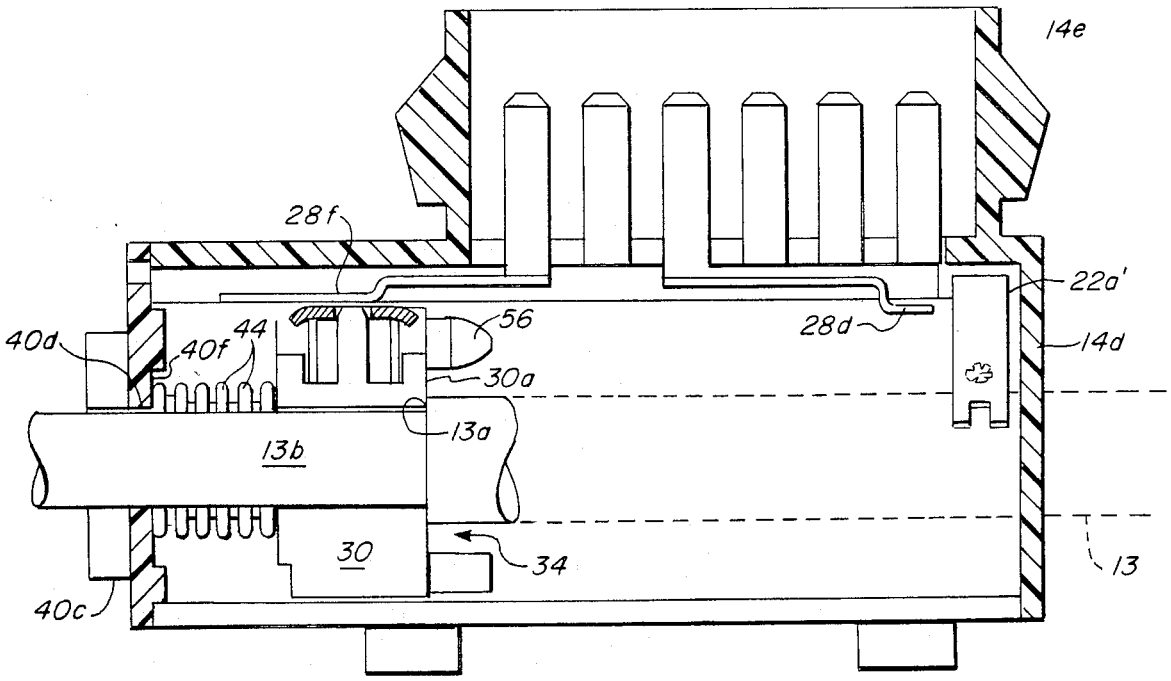
FIG. 7 is a view corresponding to FIG. 6 showing the push rod and driver in the opposite limit position.

The pair of arms 42,42 are generally symmetrically located within the housing 14. The use of two arms and their symmetrical arrangement enhances the mechanical strength of the assembled switch and reduces the possibility of switch malfunction or excessive wear due to a "cocking" of the driver (a slight twisting from its usual perpendicular orientation to its direction of travel). Each arm 42 has a reduced diameter tip 42*a* that extends through an opening in the end wall 14*d*, as shown in FIGS. 3, 6 and 7, when the base 40 is seated against the open end of the housing 14. Retaining rings 46,46 secure this relationship and hold the switch 12 in the assembled state shown in the drawings. Thus the principal internal component parts of the switch 12 can be readily assembled by loading them onto the arms 42,42. This sub-assembly can then be secured to the housing, with the terminals and contacts oriented for electrical connection with the wiper 36, simply by sliding the sub-assembly into the housing until the tips 42*a*,42*a* project fully, and then applying the retaining rings 46,46. While retaining rings are shown, it will be understood that a variety of other techniques can be used to secure the assembly such as a snap fit or ultrasonic welding.

Figure 8:
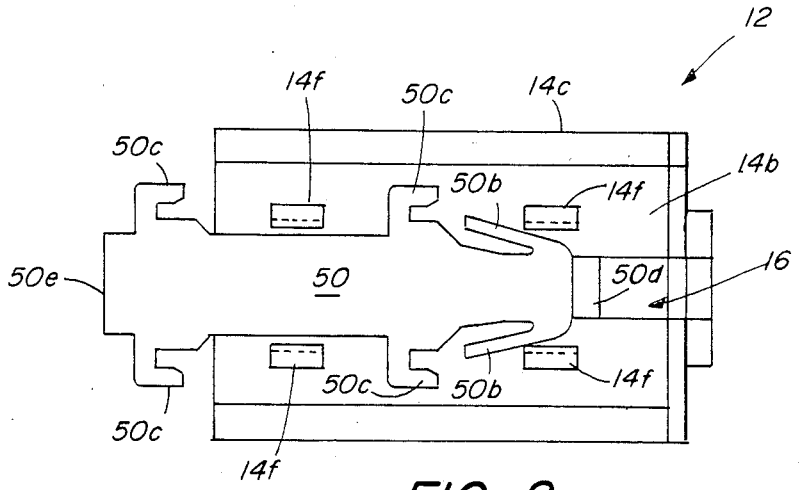
FIG. 8 is a bottom plan view of the switch shown in FIGS. 1–7 showing the locking cover being inserted to close and lock the switch onto the associated clutch push rod.
Figure 9:
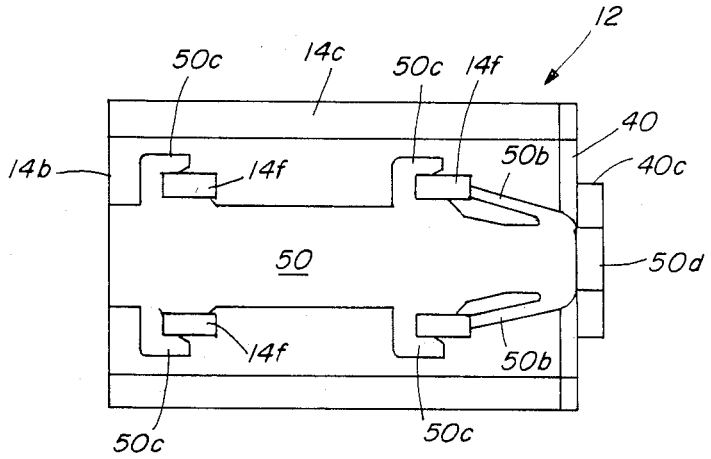
FIG. 9 is a bottom plan view corresponding to FIG. 8 showing the cover in a fully inserted and locked position.

When the switch is snap-assembled onto the rod 13, the housing 14 is fully enclosed and locked in the assembled condition by sliding a cover 50 under the mounting brackets 14*f* as shown in FIG. 8. The cover is a generally flat, plate-like member with a longitudinal ridge 50*a* that keys into the longitudinal opening 16 in the "lower" housing wall 14*b*. The cover is long enough and wide enough to block the opening fully to thereby block the entry of contaminants to the interior of the switch. A pair of laterally flexible arms 50*b*,50*b* depress toward one another when slid between a pair of the brackets 14*f* (FIG. 8), and then snap outwardly when they clear the brackets to lock the cover in position (FIG. 9). Laterally projecting, L-shaped members 50*c*, 50*c* mate with the brackets 14*f* when the cover is fully seated. End pieces 50*d* and 50*e* generally fill the opening in the base member and end wall 14, respectively.

A cam pin 56 is mounted on the driver 30. In the preferred form shown, the pin is cylindrical and has a tapered end portion. As the driver moves under the forces of the springs 44,44 toward the intial portion 32, the cam engages the contact spring 26 and deflects it downwardly to break the electrical connection between the contact rivets 27*a*, 27*b* on the end of the spring and the terminal 22*a*. This cam arrangement therefore automatically opens the EFI circuit when the clutch is not engaged.

As will be readily understood by one skilled in the art, the foregoing structure provides a multi-function switch operated by the linear movement of an actuator of a hydraulic clutch or the like that can be operatively coupled to the actuator with a simple sideways snap-fit. The clutch mechanism does not have to be disassembled for the coupling. Because the switch is also compact, in the assembly of a hydraulic clutch assembly into a vehicle, it can be assembled onto a clutch assembly with the aforementioned sideways snap-fit and then fed from an engine compartment, through a hole in a firewall having a limited diameter, and positioned within the passenger compartment, under the dashboard, for attachment to a connecting harness at the external terminals 24. It is important that with the foregoing advantages the switch is also fully enclosed once assembled onto the actuator shaft to prevent dirt, dust, and other contaminants from entering the interior of the switch where they could cause wear or interfere with the operation of the switch. Besides the foregoing advantages, the structural features described in detail above also allow the switch to be readily assembled (with respect to its component parts as well as the actuator shaft) and then locked onto the actuator.

While the invention has been described with respect to its preferred embodiment, various modifications will occur to those skilled in the art from the foregoing detailed description and the drawings. For example, while the invention has been described with reference to a switch for use in conjunction with a hydraulic clutch assembly, it may be used in conjunction with other actuator members. In one alternative arrangement, the switch can be assembled onto a shaft which forms a part of a linkage in a mechanical clutch assembly. More generally, the switch of this invention can be used wherever there is an extended actuating member that moves along its own axis. Further, while the switch has been described as controlling three circuits, using a cam action for control of one of them, it can be adapted to control as few as one, or more than three circuits, providing additional contacts, terminals, cams and related structures are suitably modified. It should also be clear that different materials could be utilized and that the precise configuration and relationship of various parts can be modified without departing from the scope of the present invention. In this respect, for example, if the actuator shaft has a non-circular cross section, then the snap fit would be via a mechanism other than a "C-shaped" recess in a resiliently deformable material. Further, while the terminals and contacts are shown as mounted on a board that is then mounted in the housing, it is possible to mount these electrical connection members directly to the housing. These and other modifications and variations are intended to fall within the scope of the appended claims.

What is claimed is:

1. A multi-function actuator switch assembled onto an actuator shaft movable along its length in a first direction, and which is fully enclosed once assembled, comprises, a hollow housing formed of a resiliently deformable insulating material that extends along said first direction and has a longitudinal opening extending in said first direction which receives said shaft through said opening, a plurality of terminals accessible from the exterior of said housing, a plurality of electrical contacts mounted at the interior of said housing, each in electrical connection with a selected one of said terminals, said contacts being arrayed in pairs that are mutually spaced along said first direction, a driver member mounted within said housing for movement generally along said first direction between an initial limit position and a fully extended limit position, contact means mounted on said driver member arranged to establish electrical connection between a selected one of said pair of contacts depending on the position of said driver member within said housing, deformable means for replaceably and operatively coupling said driver member to said shaft, means for urging said driver member toward said initial position, and means for replaceably covering said longitudinal opening to enclose the interior of said switch.

2. The actuator switch of claim 1 wherein said means for covering includes means for securing said housing against lateral deformation to lock said switch on said shaft.

3. The actuator switch of claims 1 or 2 wherein said means for urging comprises spring means and means for guiding said spring means.

4. The actuator switch of claim 3 wherein said guiding means comprises a base that closes one end of said housing and at least one guide member that extends in said first direction from said base, and said spring means comprises a coil spring carried on each of said at least one guide member.

5. The actuator switch of claim 4 wherein there are a pair of guide members and associated springs arrayed within said housing symmetrically on opposite sides of said longitudinal opening.

6. The actuator switch of claim 1 wherein said deformable means is a resiliently deformable material having a generally C-shaped opening formed in one side thereof to receive said shaft in a snap-fit.

7. The actuator switch of claim 4 wherein said base is formed of a resiliently deformable material and has a C-shaped opening for a snap-fit engagement onto said shaft.

8. The actuator switch of claim 1 wherein one of said pair of contacts includes a resilient contact arm that electrically connects said pair in its relaxed position and further comprising cam means carried on said driver member arranged to deflect said resilient contact arm to a position that opens said electrical connection when said driver member is in a preselected position along said first direction.

9. The actuator switch of claim 8 wherein said preselected position is said initial position.

10. The actuator switch of claim 8 wherein said cam means comprises a tapered cylindrical projection.

11. The actuator switch of claim 4 wherein said housing is formed integrally from a single piece of material.

12. The actuator switch of claim 11 wherein said housing includes an end wall located opposite said base, said end wall including at least one opening arranged to receive and support an end of said at least one guide member.

13. The actuator switch of claim 1 further comprising resilient means for urging said contact means into engagement with said contacts.

14. The actuator switch of claim 1 wherein said shaft has a reduced diameter portion to form an abutment shoulder for engagement with said driver member.

* * * * *